US010850156B1

(12) United States Patent
Cortes

(10) Patent No.: US 10,850,156 B1
(45) Date of Patent: Dec. 1, 2020

(54) MULTIPURPOSE EXERCISE DEVICE

(71) Applicant: Domingo Cortes, Dunkirk, NY (US)

(72) Inventor: Domingo Cortes, Dunkirk, NY (US)

( * ) Notice: Subject to any disclaimer, the term of this patent is extended or adjusted under 35 U.S.C. 154(b) by 0 days.

(21) Appl. No.: 16/699,460

(22) Filed: Nov. 29, 2019

(51) Int. Cl.

| | |
|---|---|
| ***A63B 21/00*** | (2006.01) |
| ***A63B 21/055*** | (2006.01) |
| ***E05D 3/10*** | (2006.01) |
| ***A63B 21/04*** | (2006.01) |
| ***E05D 7/10*** | (2006.01) |

(52) U.S. Cl.
CPC .... *A63B 21/4045* (2015.10); *A63B 21/00047* (2013.01); *A63B 21/0442* (2013.01); *A63B 21/0557* (2013.01); *A63B 21/4035* (2015.10); *E05D 3/10* (2013.01); *E05D 7/1005* (2013.01); *E05D 7/105* (2013.01); *E05D 7/1055* (2013.01); *E05D 2007/1027* (2013.01)

(58) Field of Classification Search
CPC ..... A63B 21/4045; A63B 21/0442; A63B 21/4035; A63B 21/00047; A63B 21/0557; A63B 22/20; A63B 22/201; A63B 22/203; A63B 22/14; A63B 22/0061; A63B 22/205; A63B 22/0023; A63B 23/03516; A63B 69/0022; A63B 2244/18; A63B 2244/183; A63B 2022/206; E05D 3/10; E05D 3/06; E05D 3/12; E05D 3/14; E05D 7/1005; E05D 7/10; E05D 7/1044; E05D 7/105; E05D 7/1055; E05D 7/12; E05D 2007/1027; E05D 2007/126; E05D 15/50; E05D 15/502; Y10T 16/54052
USPC ..... 16/254, 260, 261, 262, 263, 270, 271, 16/272, 365, 366, 368, 369, 370, 229, 16/230, 231, 346
See application file for complete search history.

(56) References Cited

U.S. PATENT DOCUMENTS

| | | | | |
|---|---|---|---|---|
| 518,741 A * | 4/1894 | Lawrence | E05D 3/12 | 16/366 |
| 4,506,884 A * | 3/1985 | Hankin | A63B 22/203 | 482/131 |
| 7,326,153 B2 * | 2/2008 | Bond | A63B 21/055 | 482/141 |
| 7,892,152 B1 * | 2/2011 | Teng | A63B 23/03541 | 482/142 |
| 9,011,302 B2 * | 4/2015 | Lalaoua | A63B 21/0414 | 482/121 |

(Continued)

*Primary Examiner* — Loan B Jimenez
*Assistant Examiner* — Kathleen Vermillera
(74) *Attorney, Agent, or Firm* — The Bilicki Law Firm, P.C.

(57) ABSTRACT

In general, a multifunctional exercise device includes a first lateral slide component and a second lateral slide component. The multifunctional exercise device includes a hinge assembly with a first pivotal hinge piece connected to the first lateral slide component at a first side pivot point and a second pivotal hinge piece connected to the second lateral slide component at a second side pivot point. A first pin is adapted to retain the first pivotal hinge piece and second pivotal bracket piece in a connected, pivotal position at a center pivot. A first slidable hand grip adapted to slide along the first lateral slide component and a second slidable hand grip adapted to slide along the second lateral slide component are also included. First and second adjustable feet are provided for allowing the first lateral slide component and the second lateral slide component to be adjusted to various equal or unequal heights.

17 Claims, 12 Drawing Sheets

(56) References Cited

U.S. PATENT DOCUMENTS

| | | | | |
|---|---|---|---|---|
| 9,492,705 | B2 * | 11/2016 | Hong | A63B 21/0442 |
| 9,700,757 | B2 * | 7/2017 | Shade | A63B 21/4035 |
| 10,376,738 | B2 * | 8/2019 | Baril | A63B 21/4045 |
| 2012/0035028 | A1 * | 2/2012 | Ahmadi Mirghaed | A61H 1/0244<br>482/129 |
| 2012/0053019 | A1 * | 3/2012 | Reyes | A63B 21/00069<br>482/52 |
| 2014/0141949 | A1 * | 5/2014 | Mills | A63B 23/1236<br>482/140 |

* cited by examiner

MULTIPURPOSE EXERCISE DEVICE

FIELD OF THE INVENTION

This invention relates to exercise equipment. More particularly, this invention relates to an apparatus designed for performing prone exercise using a sliding exercise device.

SUMMARY

In general, a multifunctional exercise device includes a first lateral slide component having an outer end and an inner end and an indented reduced friction slide area, with the first lateral slide component forming a decline from the inner end to the outer end. A second lateral slide component is also included having an outer end and an inner end and an indented reduced friction slide area, with the second lateral slide component forming a decline from the inner end to the outer end. A hinge assembly includes a first pivotal hinge piece connected to the inner end of the first lateral slide component and a second pivotal hinge piece connected to the inner end of the second lateral slide component. A first pin is adapted to retain the first pivotal hinge piece and second pivotal hinge piece in an engaged position.

A first slidable hand grip adapted to slide along the slide area of the first lateral slide component and a second slidable hand grip adapted to slide along the slide area of the second lateral slide component are also included. First and second adjustable feet are provided for allowing the inner end of the first lateral slide component and the inner end of the second lateral slide component to be adjusted to various equal or unequal heights.

In some embodiments of the multifunctional exercise device the first pivotal hinge piece and the second pivotal hinge piece may be disengaged such that the first end of the first pivotal hinge piece and the first end of the second pivotal hinge piece are positioned adjacent to one another and the second end of the first pivotal hinge piece and the second end of the second pivotal hinge piece are spaced apart, thereby causing the first lateral slide component and the second lateral slide component to be positioned at an angle to one another. Further, the first pivotal hinge piece and the second pivotal hinge piece may each include a first end with a first end aperture formed therein and a second end with a second end aperture formed therein and a first double pin element for engaging the first end apertures and maintaining the first end of the first pivotal hinge piece and the first end of the second pivotal hinge piece adjacent to one another and a second double pin element for engaging the second end apertures and maintaining the second end of the first pivotal hinge piece and the second end of the second pivotal hinge piece spaced apart.

DETAILED DESCRIPTION OF THE DRAWINGS

Figure 1:
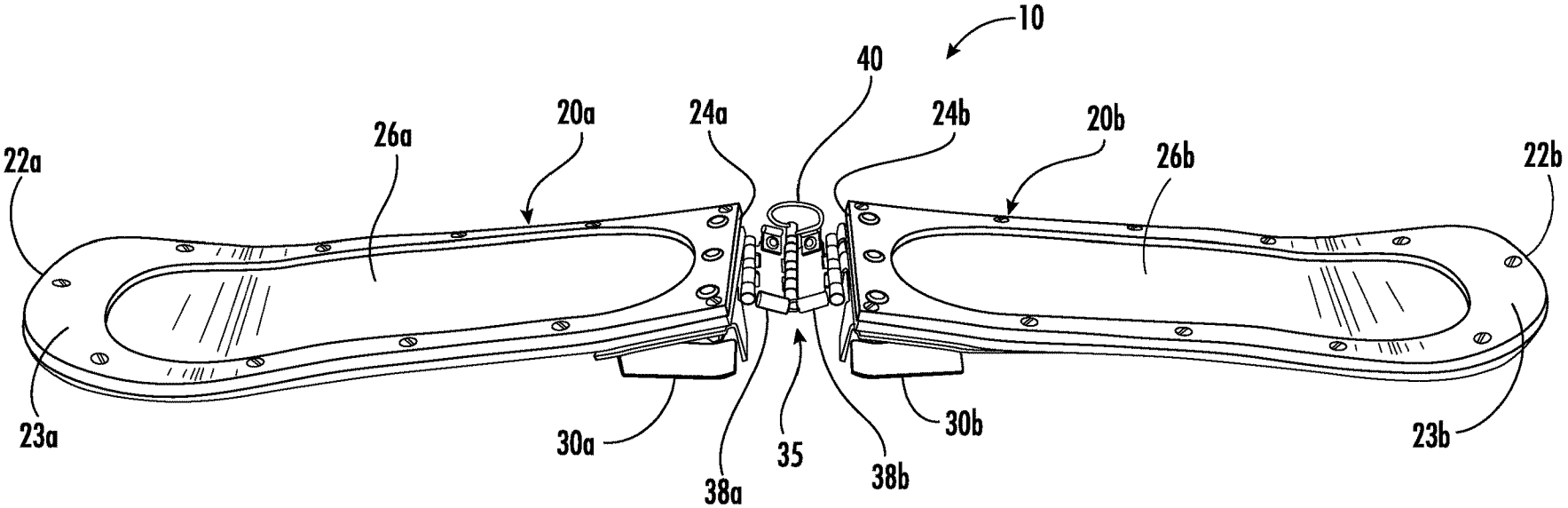
FIG. 1 is a view of a multipurpose exercise device in an open position.
Figure 2:
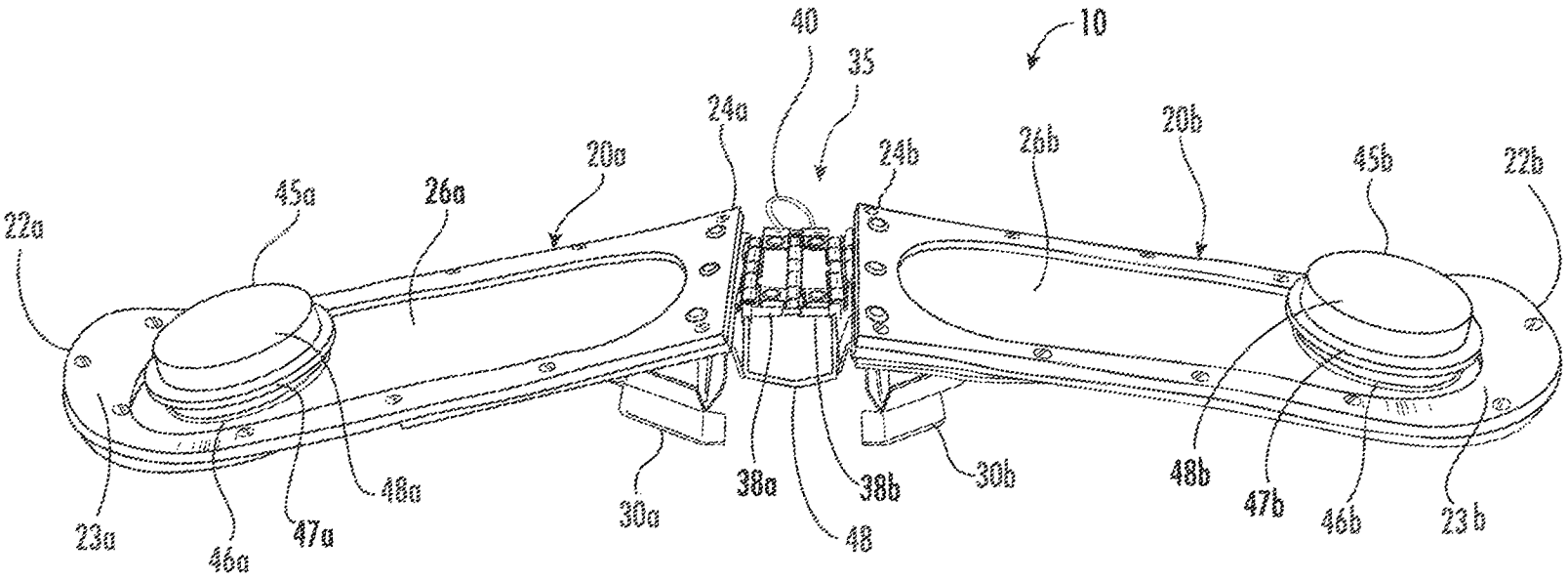
FIG. 2 is a view of the multipurpose exercise device in an inclined position.
Figure 3:
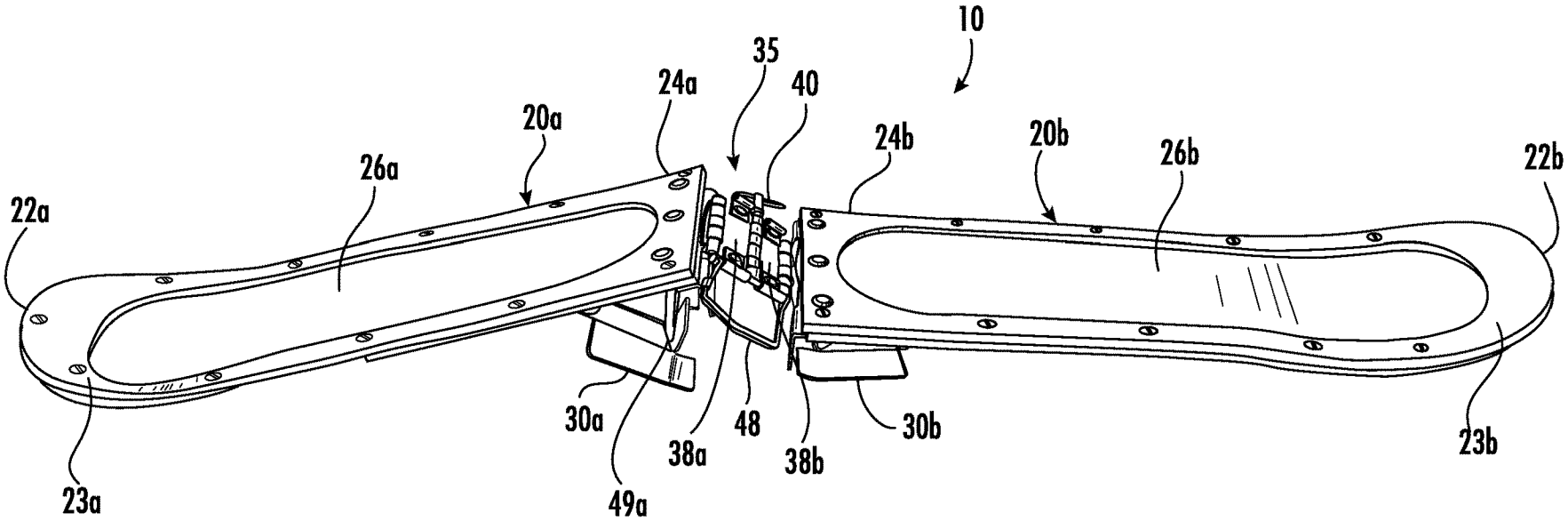
FIG. 3 is a view of the multipurpose exercise device in an offset inclined position.

Throughout the detailed description like reference numerals correspond to like elements, and repetitive description of such elements is excluded. As shown in FIGS. 1-3, a multifunctional exercise device 10 is shown in various positions. Exercise device 10 includes a first lateral slide component 20*a* having an outer end 22*a* and an inner end 24*a*. Outer end 22*a* may include an upward slope that is wider than the body or mid-section of first lateral slide component 20*a*, thereby forming a rocker 23*a*. An indented reduced friction slide area 26*a* is positioned within the first lateral slide component 20*a* to provide an area for a slidable hand grip to move back and forth. Slide area 26*a* also includes an upward slope near outer end 22*a*, which may increase the intensity of the exercise. Slide area 26*a* may be formed of a metal or other low friction material. As shown in FIG. 1, first lateral slide component 20*a* forms a decline from inner end 24*a* to outer end 22*a*, which is created by an adjustable foot 30*a* for causing inner end 24*a* to be raised relative to outer end 22*a*.

Exercise device 10 includes also includes a second lateral slide component 20*b* having an outer end 22*b* and an inner end 24*b*. Outer end 22*b* may include an upward slope and may be wider than the body or mid-section of second lateral slide component 20*b*, thereby forming a rocker 23*b*. An indented reduced friction slide area 26*b* is positioned within the second lateral slide component 20*b* to provide an area for a slidable hand grip to move back and forth. Slide area 26*b* also includes an upward slope near outer end 22*b*, which may increase the intensity of the exercise. Slide area 26*b* may be formed of a metal or other low friction material. As shown in FIG. 1, second lateral slide component 20*b* forms a decline from inner end 24*b* to outer end 22*b*, which is created by an adjustable foot 30*b* for causing inner end 24*b* to be raised relative to outer end 22*b*.

A hinge assembly 35 includes a first pivotal hinge piece 38*a* connected to the inner end 24*a* of the first lateral slide component 20*a* and a second pivotal hinge piece 38*b* connected to the inner end 24*b* of the second lateral slide component 20*b*. A first pin 40 is adapted to retain the first pivotal hinge piece 38*a* and second pivotal hinge piece 38*b* in an engaged position, as shown in FIG. 1.

As shown in FIG. 2, a first slidable hand grip 45*a* is adapted to slide along the slide area 26*a* of the first lateral slide component 20*a* and a second slidable hand grip 45*b* is adapted to slide along the slide area 26*b* of the second lateral slide component 20*b*. Each of first and second slidable hand grips 45*a*, 45*b* include a lower reduced friction layer 46*a*, 46*b* for sliding along exercise device 10 or along a tabletop, wall or other surface. In addition, each hand grip 45*a*, 45*b* may include an inner support layer 47*a*, 47*b* to give hand grips 45*a*, 45*b* additional support. A top layer 48*a*, 48*b* is also provided on each hand grip for user comfort. The top layer may be formed form any cushioned material such as rubber or silicone. As also shown in FIG. 2, first and second adjustable feet 30*a* and 30*b*, which are attached to the first and second lateral slide components 20*a* and 20*b*, respectively, may both be raised in order to provide a steeper angle for first lateral slide component 20*a* and second lateral slide component 20*b*, which increases the resistance to the user and provides deeper resistance during a fly type exercise. A removable U-shaped retaining element 48 is also provided for retaining the first pivotal hinge piece 38*a* and second pivotal hinge piece 38*b* in a connected position.

FIG. 3. Illustrates another configuration of exercise device 10 wherein first lateral slide component 20*a* is in an angled position due to adjustable foot 30*a* being in a raised position while second lateral slide component 20*b* is in a flat or slightly inclined position due to the folded position of adjustable foot 30*b*. A clip or other retaining element 49*a* is shown holding adjustable foot 30*a* in a raised position. One skilled in the art should understand that either one or both of lateral slide components (20*a*, 20*b*) may be positioned at a variety of different inclines according to the needs of a user. The higher the incline, the stronger the resistance of the exercise.

Figure 4:
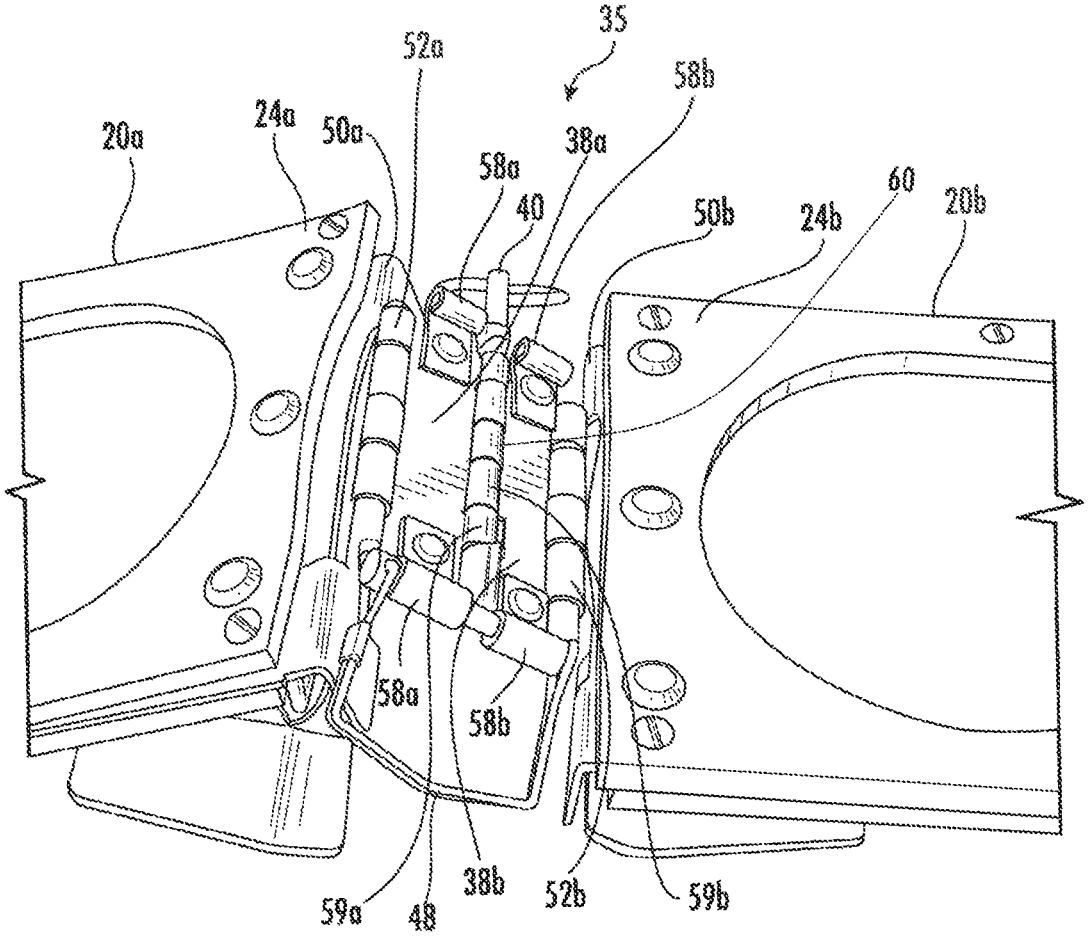
FIG. 4 is an enlarged view of a hinge assembly of the exercise device of FIG. 3.
Figure 6:
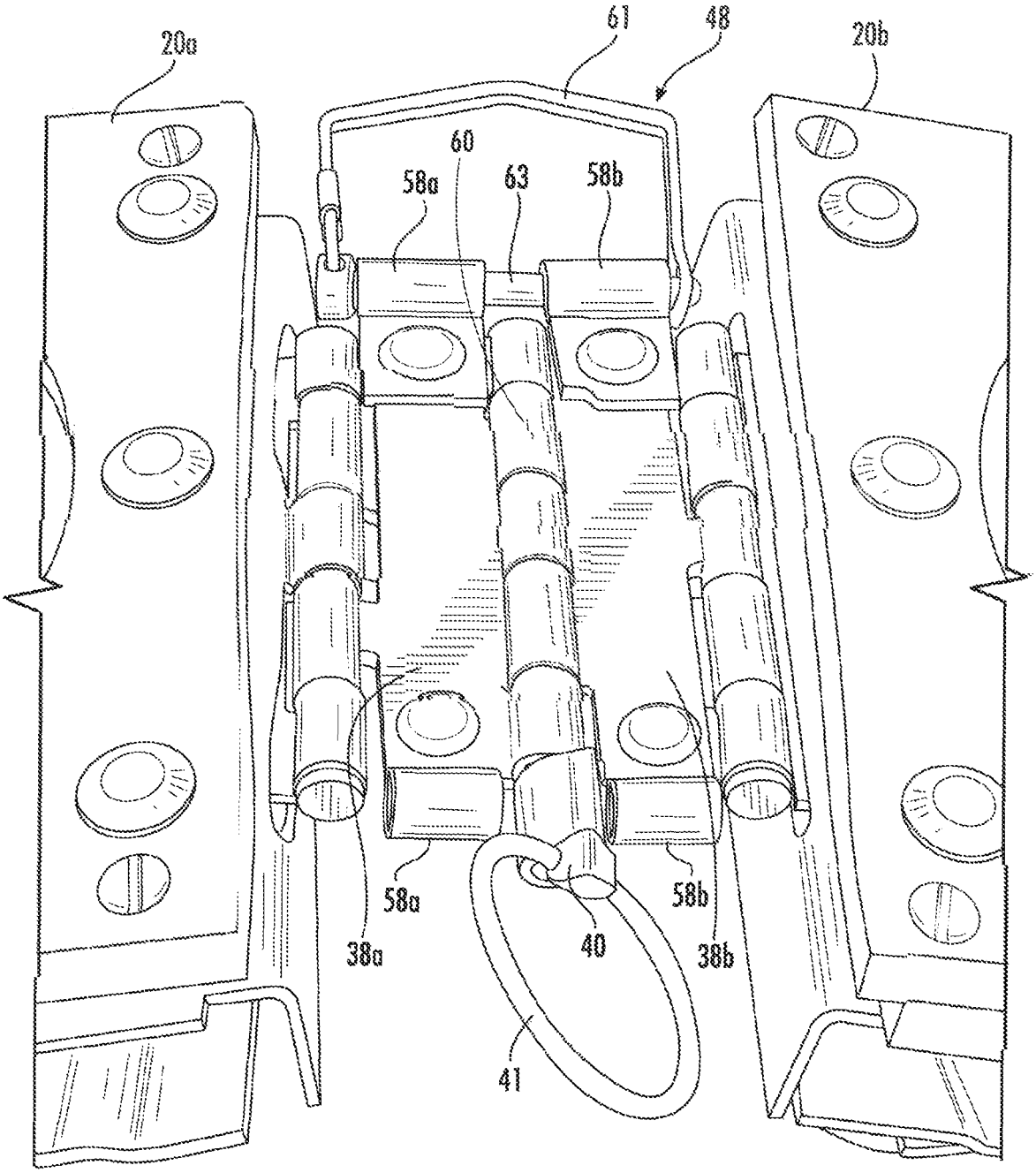
FIG. 6 is an enlarged view of a hinge assembly in a fully engaged configuration.

FIGS. 4 and 6 are enlarged views of the hinge assembly 35 shown with first and second lateral slide components 20*a* and 20*b* in offset and even positions, respectively. Hinge assembly 35 includes a fixed first bracket 50*a* connected to the inner end 24*a* of the first lateral slide component 20*a* and first side pivot point 52*a* that is rotatably connected to first pivotal hinge piece 38*a*. Similarly, hinge assembly 35 includes a fixed bracket 50*b* connected to the inner end 24*b* of the second lateral slide component 20*b* and second side pivot point 52*b* that is rotatably connected to a second pivotal hinge piece 38*b*. Each pivotal hinge piece (38*a*, 38*b*) includes a corresponding first and second cylindrical loop 58*a*, 58*b* for receiving a bar 63 from removable U-shaped retaining element 48, which may be positioned on either top ends or bottom ends of aligned pivotal hinge pieces 38*a* and 38*b*. Pivotal hinge pieces 38*a* and 38*b* also include cylindrical apertures 59*a*, 59*b* that align to allow for insertion of a removable engagement member, such as a pin 40 therein to retain pivotal hinge pieces 38*a* and 38*b* in a connected and pivotable position, thereby forming a center pivot point 60. FIG. 6 illustrates hinge assembly 35 in a fully locked position with both U-shaped retaining element 48 and pin 40 locked in place to ensure maximum stability of exercise device 10.

Figure 5:
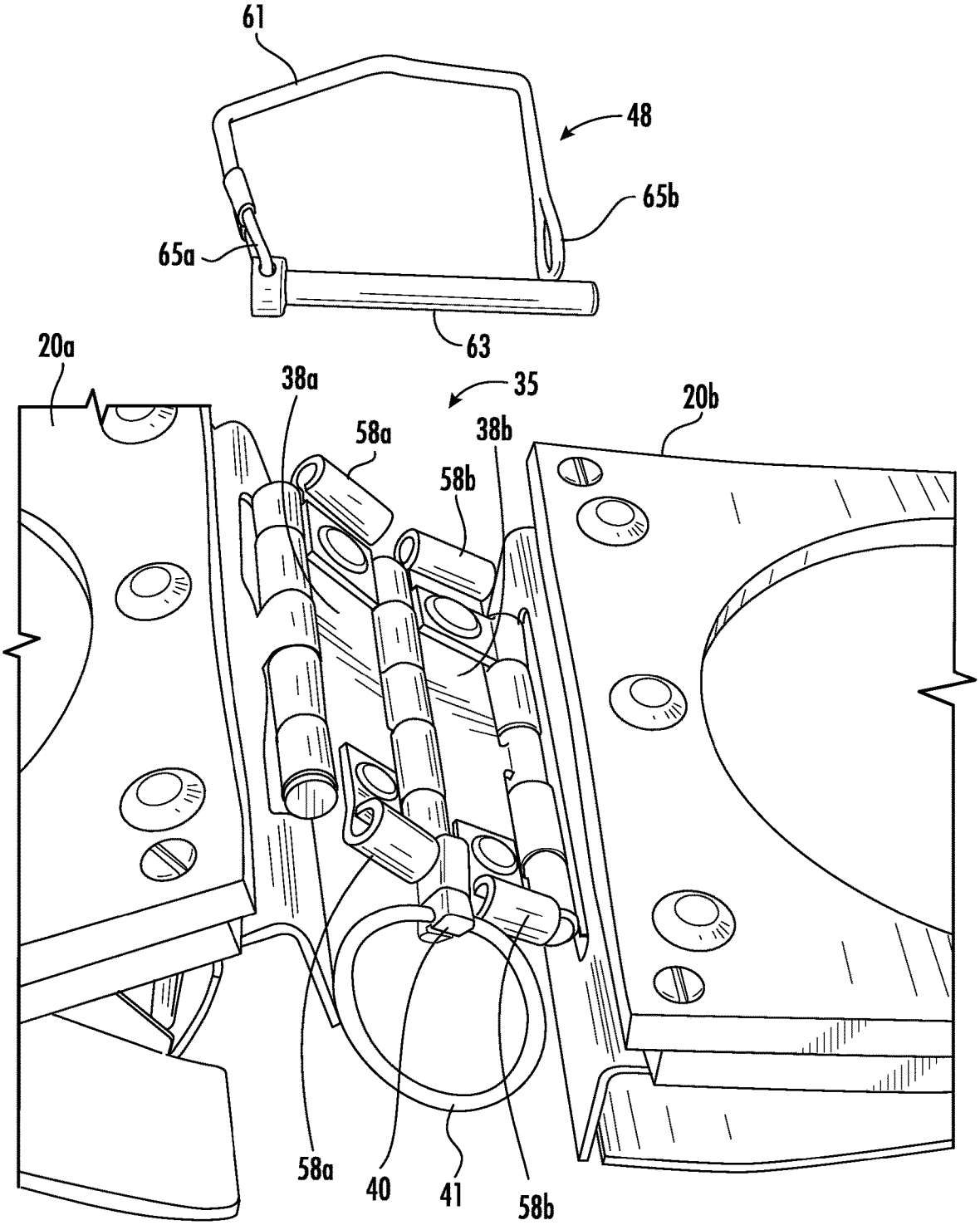
FIG. 5 is an enlarged view of a hinge assembly in a partially disengaged configuration.

FIG. 5 is an enlarged view of an enlarged view of the hinge assembly 35 with first lateral slide component 20*a* in a raised position and second lateral slide component 20*b* in a lowered position. As shown, pin 40 having a ring 41 is positioned within for securing exercise device 10. However, U-shaped retaining element 48 is shown disengaged from exercise device 10. U-shaped retaining element 48 includes U-portion 61 and a bar 63. U-shaped portion 61 includes a first loop 65*a* connected to bar 63 and a second loop 65*b* for securing to bar 63 once in position on hinge assembly 35. Cylindrical loops 58*a*, 58*b*, which are formed on pivotal bracket pieces 38*a* and 38*b*, are adapted to receive bar 63 of U-shaped retaining element 48. Pin 40 may be used with or without U-shaped retaining element 48. Whichever configuration a user chooses, U-shaped retaining element 48 provides added stability to exercise device 10.

Figure 7:
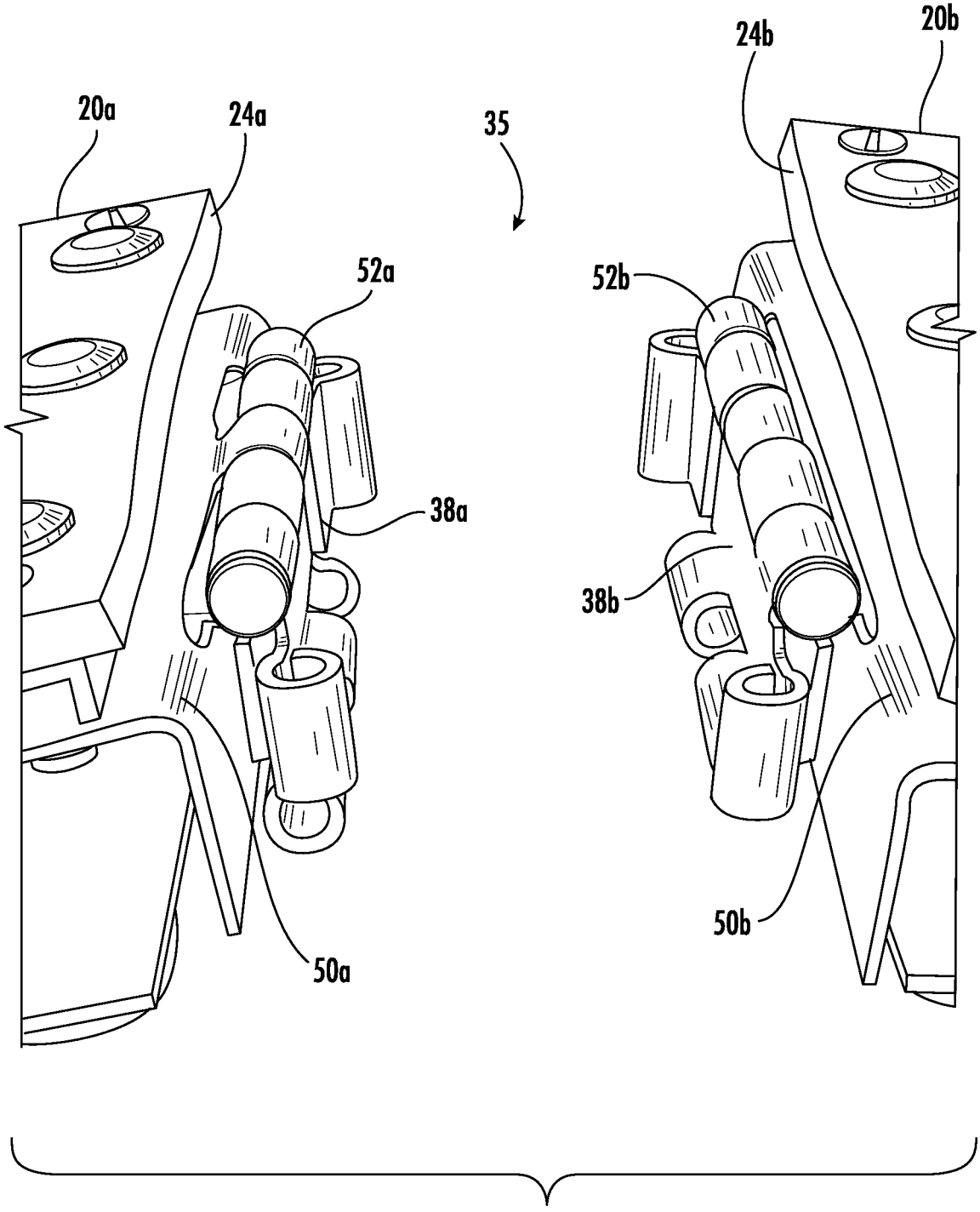
FIG. 7 is an enlarged view of a hinge assembly in a fully disengaged configuration.

FIG. 7 illustrates hinge assembly 35 in a disengaged position wherein the first pivotal hinge piece 38*a* and the second pivotal hinge piece 38*b* are disengaged by removal of the pin 40 at the center pivot point 60, thereby allowing the first lateral slide component 20*a* and the second lateral slide component 20*b* to be positioned at an angle to one another. In particular, pin 40 and U-shaped retaining element 48 are removed. First pivotal hinge piece 38*a* is rotated about first side pivot point 52*a* towards fixed bracket 50*a*, which is connected to the inner end 24*a* of the first lateral slide component 20*a*. Similarly, pivotal hinge piece 38*b* is rotated about second side pivot point 52*b* towards fixed bracket 50*b*, which is connected to the inner end 24*b* of the second lateral slide component 20*b*.

Figure 8:
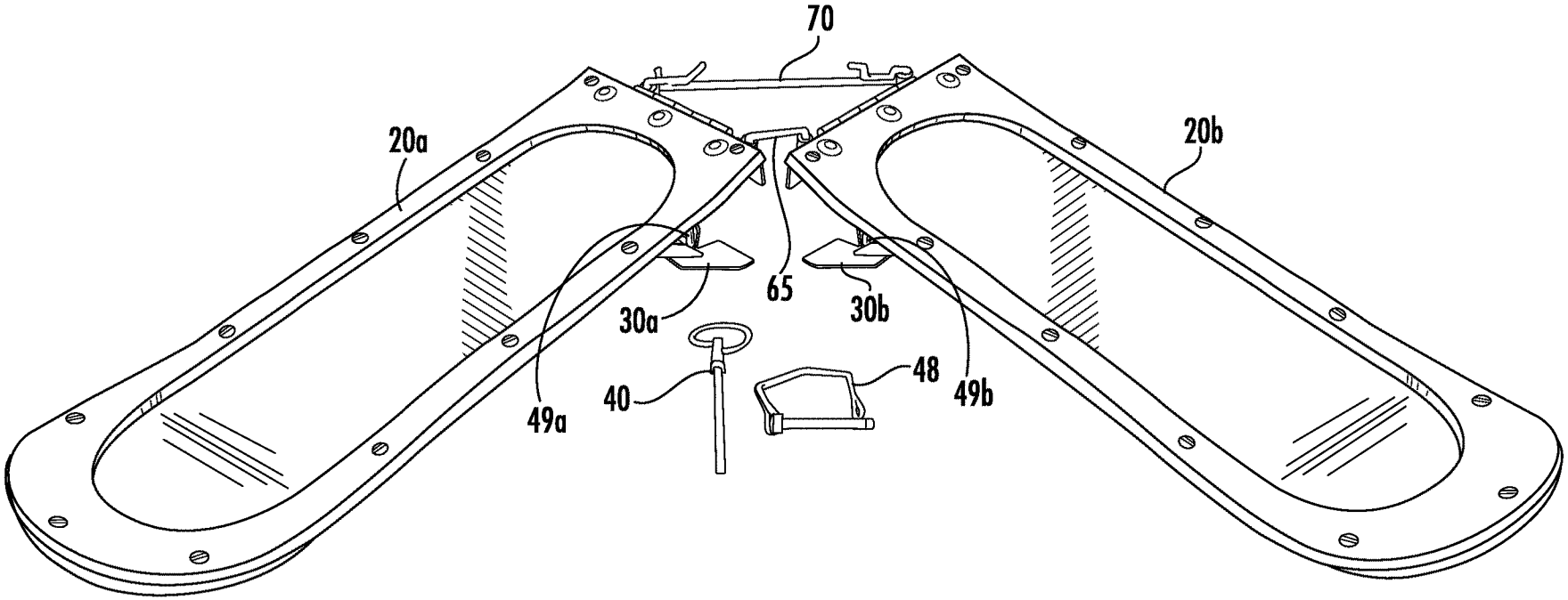
FIG. 8 is a view of an exercise device in an angled configuration.
Figure 9:
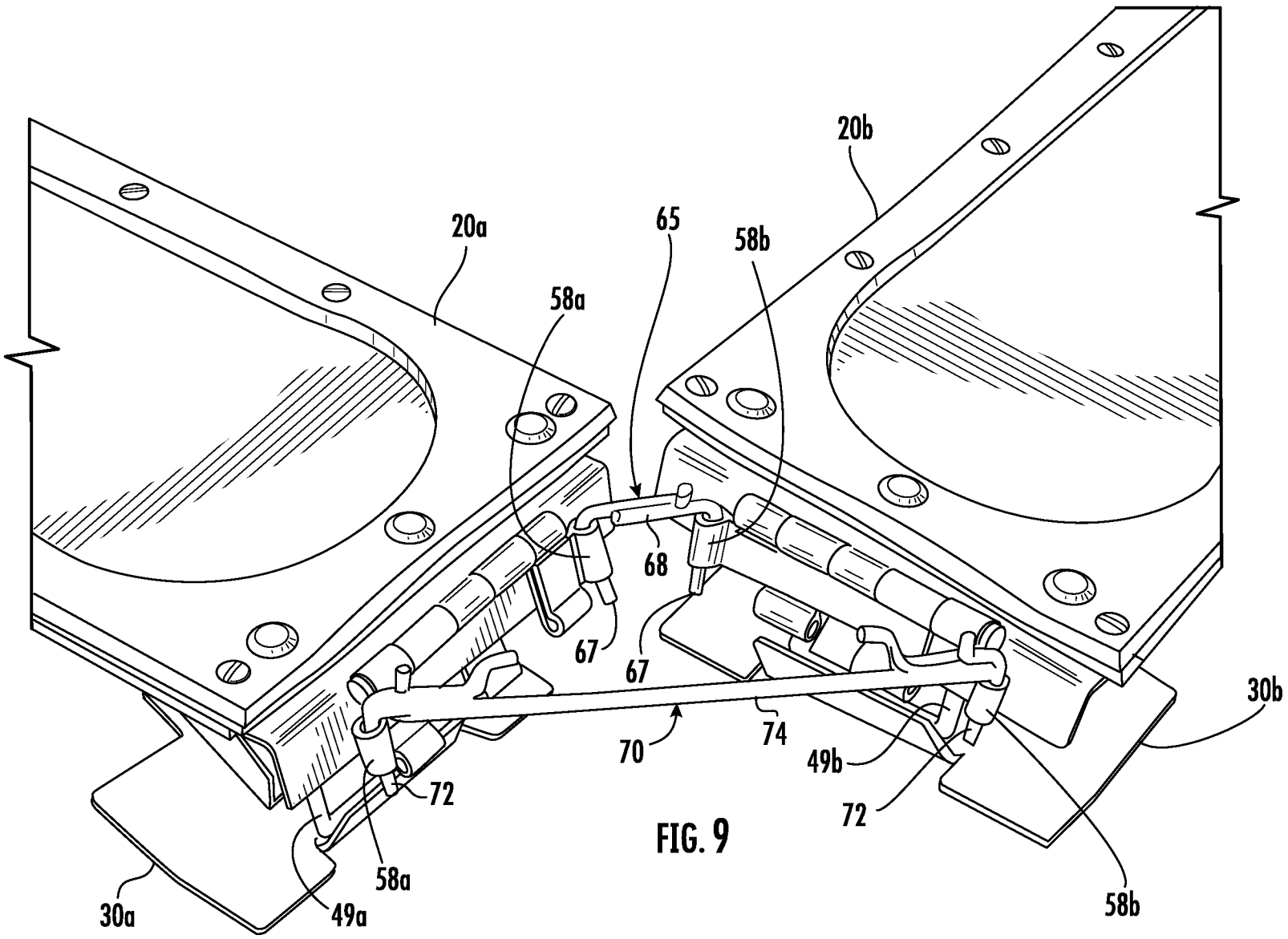
FIG. 9 is a view of an exercise device in an alternate angled configuration.

Once hinge assembly 35 is disengaged, as in FIG. 7, first lateral slide component 20*a* and second lateral slide component 20*b* may be positioned at an angle to one another, as shown in FIG. 8. In some embodiments, first lateral slide component 20*a* and second lateral slide component 20*b* may be positioned such that they angle towards a user (FIG. 8) or in some embodiments the components may be positioned to angle away from a user (FIG. 9). As with previous embodiments, adjustable feet 30*a* and 30*b* may be adjusted at a lowered or inclined position, such as with use of clips 49*a*, 49*b*, depending on the desired resistance. As shown in detail in FIGS. 8 and 9, one or more retaining pieces of varying lengths may be used to stabilize exercise device 10. For example, as shown in FIG. 9, a small retaining piece, such as double pin element 65, includes a pair of downwardly extending bars 67 and a cross bar 68. Downwardly extending bars 67 are adapted to fit within cylindrical loops 58*a* and 58*b* while they are disengaged from one another. Further, a larger retaining piece, such as double pin element 70, includes a pair of downwardly extending bars 72 and a cross bar 74. Downwardly extending bars 72 are adapted to fit within cylindrical loops 58*a* and 58*b* while they are disengaged from one another. In the embodiment shown in FIG. 8, first double pin element 65 maintains the bottom end of the first pivotal hinge piece 38*a* and the bottom end of the second pivotal hinge piece 38*b* adjacent to one another, while second double pin element 70 maintains top end of the first pivotal hinge piece and the top end of the second pivotal hinge piece spaced apart, thereby allowing first and second lateral slide components to be positioned at an angle to one another forming a V-shape.

Figure 10:
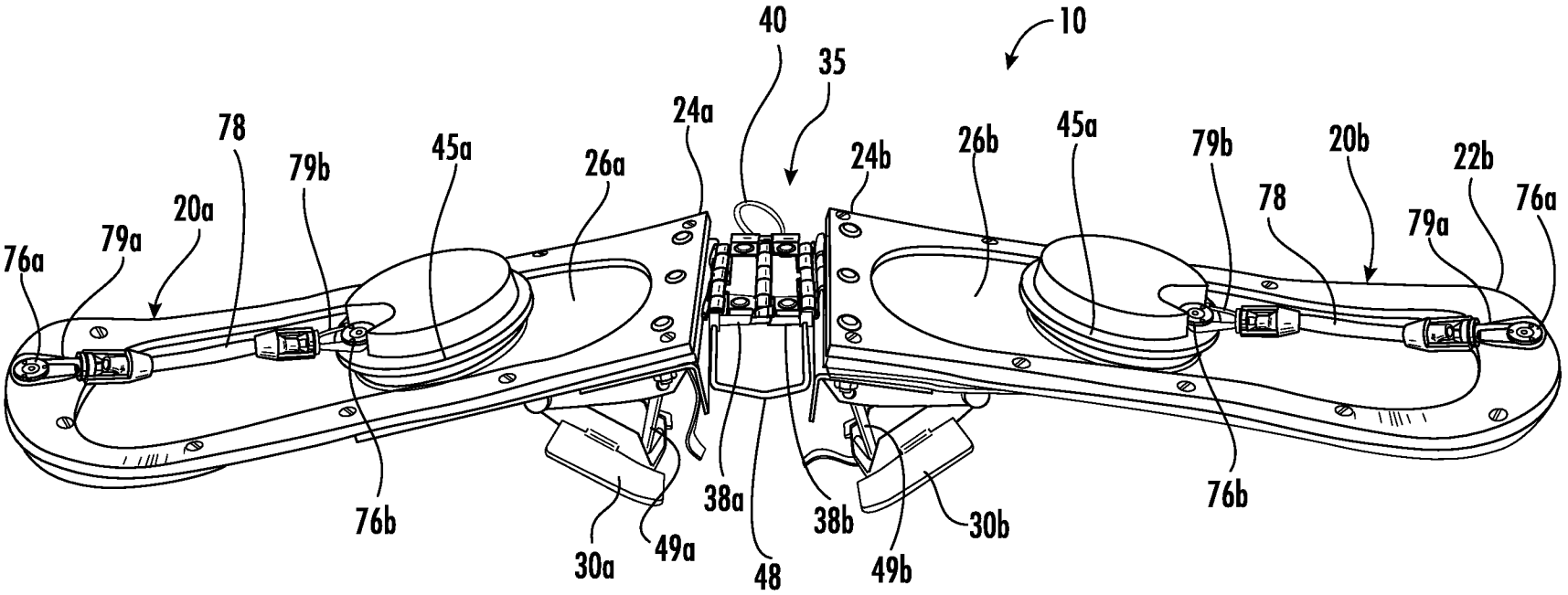
FIG. 10 is a view of an exercise device using exercise bands.

As shown in FIG. 10, exercise device 10 may include at least one resistance 78 band having a first end 79*a* and a second end 79*b*. First end is attached to a connector 76*a* on first lateral slide component 20*a* and second end 79*b* is attached to a connector 76*b* on slidable hand grip 45*a*. Resistance band 78 provides additional resistance to a user when slidable hand grip 45*a* slides along slide area 26*a*. Similarly, a resistance band may be attached to slidable hand grip 45*b* for additional resistance when sliding along slide area 26*b*. A single band or multiple bands may be used so that unilateral or bilateral resistance may be achieved.

Figure 11:
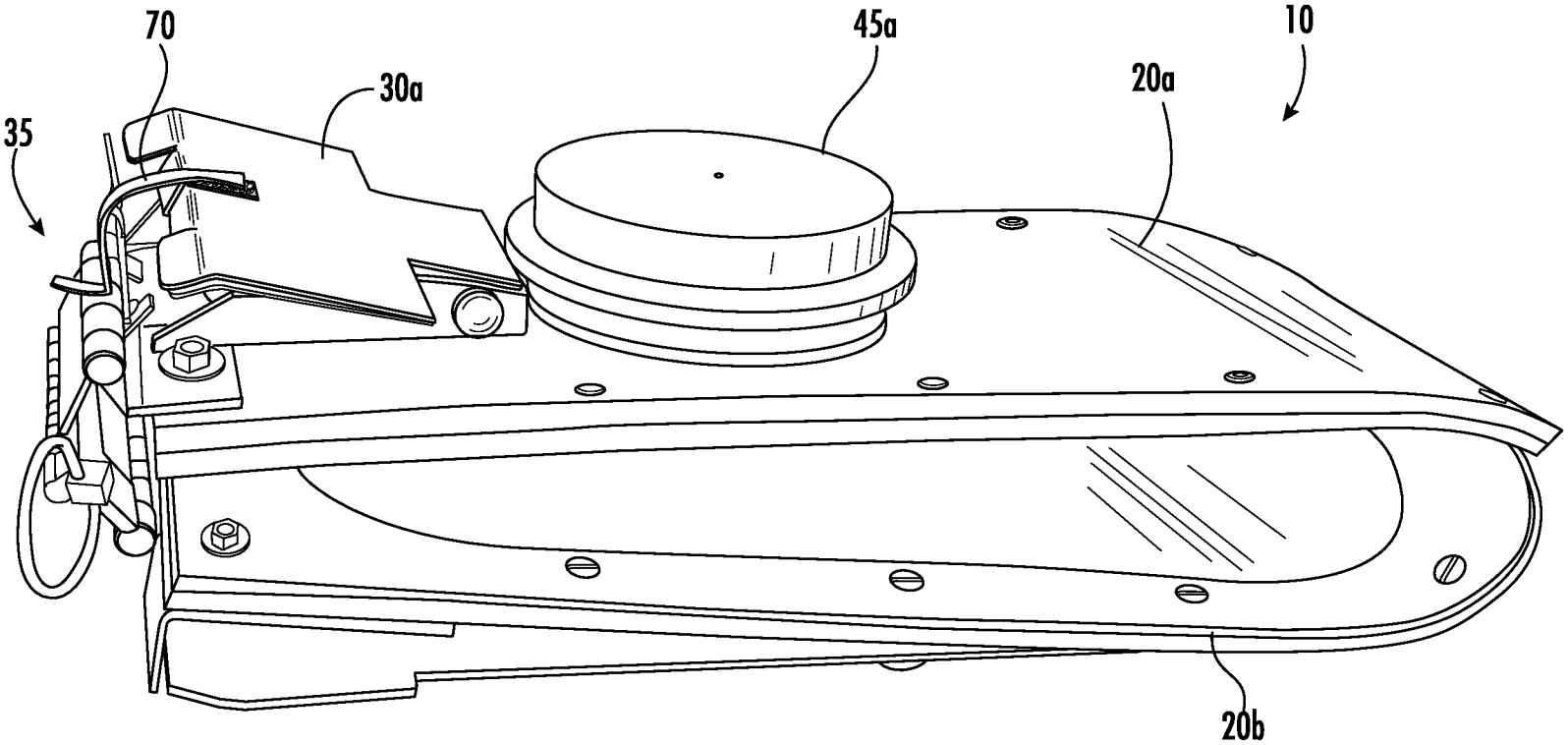
FIG. 11 is a side view of the exercise device in a folded position.
Figure 12:
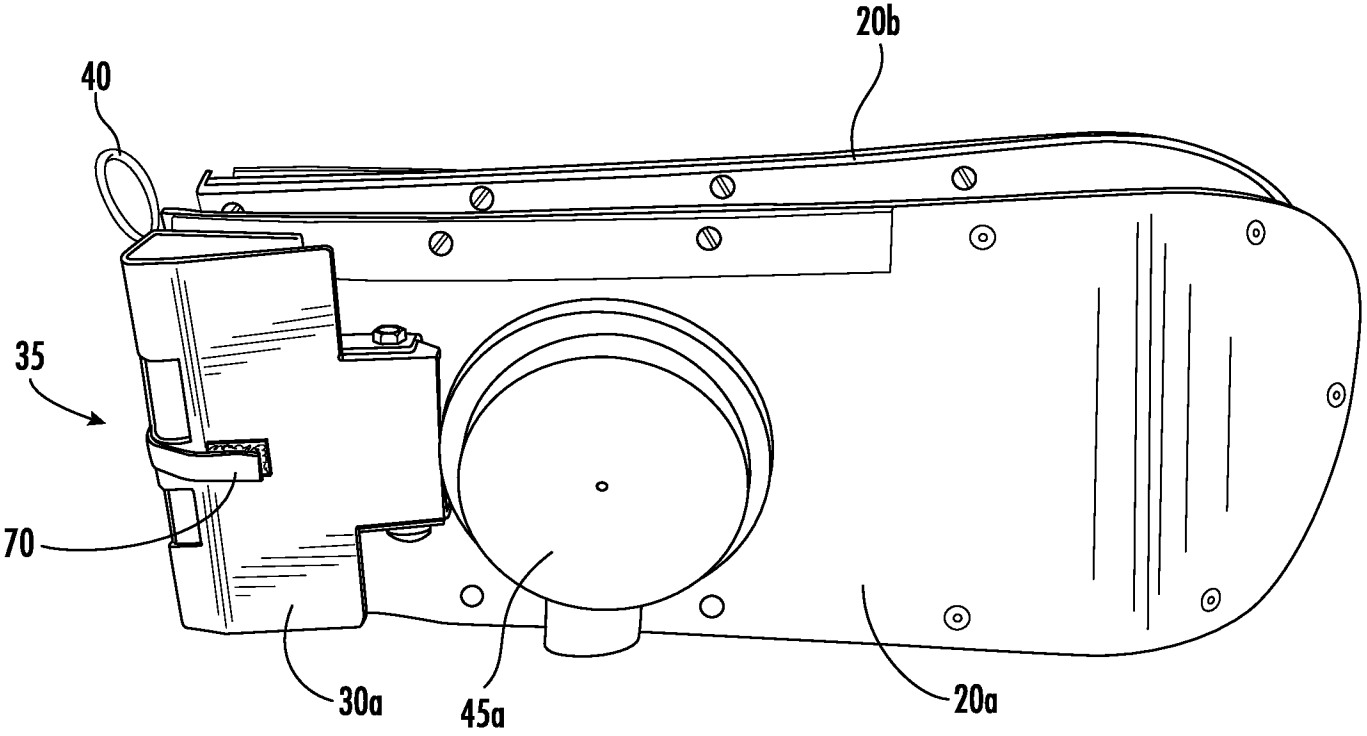
FIG. 12 is a top view of the exercise device in a folded position.

FIGS. 11 and 12 illustrate that exercise device 10 may be folded to facilitate portability. When pin 40 is positioned within hinge assembly 35, first side pivot point 52*a*, second side pivot point 52*b*, and center pivot point 60 first lateral slide component 20*a* to be folded over second lateral slide component 20*b*. Slidable hand grips 45*a*, 45*b* may be attached to first or second lateral slide components via Velcro or another attachment member (not shown) in order to prevent their separation from exercise device 10. A retaining element, such as Velcro piece 70, may be used to hold feet 30*a*, 30*b* in a folded position. As shown in FIGS. 11 and 12, hand grip 45 is shown attached to a back side (not labeled) of first lateral slide component 20*a*.

Although the present invention has been described with reference to the embodiments and the accompanying drawings, it is not limited to the embodiments and the drawings. It should be understood that various modifications and changes can be made by those skilled in the art without departing from the spirit and scope of the present invention defined by the accompanying claims.

The invention claimed is:

1. A multifunctional exercise device comprising:

a first lateral slide component having an outer end and an inner end and a slide area;

a second lateral slide component having an outer end and an inner end and a slide area;

a hinge assembly including:

a first bracket piece fixed to the inner end of the first lateral slide component and a second bracket piece fixed to the inner end of the second lateral slide component;

a first pivotal hinge piece with a first end and a second end;

a second pivotal hinge piece with a first end and a second end;

wherein said first pivotal hinge piece is pivotally connected to the first bracket piece at the first end creating a first side pivot point and pivotally connected to the second pivotal hinge piece at the second end creating a center pivot point, and said second pivotal hinge piece is pivotally connected to the second bracket piece at the first end creating a second side pivot point and pivotally connected to the first pivotal hinge piece at the second end at the center pivot point;

a removable engagement member adapted to retain the first pivotal hinge piece and second pivotal hinge piece in a connected and pivotable position at the center pivot point; and a first adjustable foot connected to the inner end of the first lateral slide component and a second adjustable foot connected to the inner end of the second lateral slide component, said first adjustable foot and second adjustable foot allowing the first lateral slide component and the second lateral slide component to be independently adjusted to various equal or unequal heights based on positions of the first adjustable foot and the second adjustable foot, and the first side pivot point, second side pivot point and center pivot point.

2. The multifunctional exercise device of claim 1, further including a first slidable hand grip adapted to slide along the slide area of the first lateral slide component and a second slidable hand grip adapted to slide along the slide area of the second lateral slide component.

3. The multifunctional exercise device of claim 2, wherein the hinge assembly further includes a removable U-shaped retaining element for retaining the first pivotal hinge piece and second pivotal hinge piece in a connected position.

4. The multifunctional exercise device of claim 2, further including at least one of a resistance band connected to an outer end of the first lateral slide component and the first slidable hand grip for providing resistance for a user and a second resistance band connected to an outer end of the second lateral slide component and the second slidable hand grip for providing resistance for a user.

5. The multifunctional exercise device of claim 1, wherein the outer end of the first lateral slide component forms an upward slope, thereby forming a first rocker, and wherein the outer end of the second lateral slide component forms an upward slope, thereby forming a second rocker.

6. The multifunctional exercise device of claim 1, wherein the engagement member is a pin.

7. The multifunctional exercise device of claim 1, wherein the first side pivot point, second side pivot point and center pivot point are adapted to pivot such that the first lateral slide component and the second lateral slide component are stacked.

8. The multifunctional exercise device of claim 1, wherein the first pivotal hinge piece and the second pivotal hinge piece are adapted to be disengaged by removal of said engagement member at the center pivot point, thereby allowing the first lateral slide component and the second lateral slide component to be positioned at an angle to one another.

9. The multifunctional exercise device of claim 1, wherein the first pivotal hinge piece and the second pivotal hinge piece each include a top end with a top cylindrical loop formed therein and a bottom end with a bottom cylindrical loop formed therein and a first double pin element for engaging the top cylindrical loops and maintaining the top end of the first pivotal hinge piece and the top end of the second pivotal hinge piece adjacent to one another and a second double pin element for engaging the bottom cylindrical loops and maintaining the bottom end of the first pivotal hinge piece and the bottom end of the second pivotal hinge piece spaced apart.

10. A multifunctional exercise device comprising:

a first lateral slide component having an outer end and an inner end and a slide area;

a second lateral slide component having an outer end and an inner end and a slide area;

a hinge assembly including a first bracket piece fixed to the inner end of the first lateral slide component and a second bracket piece fixed to the inner end of the second lateral slide component, a first pivotal hinge piece with a first end and a second end, a second pivotal hinge piece with a first end and a second end, wherein said first pivotal hinge piece is pivotally connected to the first bracket piece at the first end creating a first side pivot point and pivotally connected to the second pivotal hinge piece at the second end creating a center pivot point, and said second pivotal hinge piece is pivotally connected to the second bracket piece at the first end creating a second side pivot point and pivotally connected to the first pivotal hinge piece at the second end at the center pivot point;

a removable pin adapted to retain the first pivotal hinge piece and second pivotal hinge piece in a connected and pivotable position at the center pivot point and a removable U-shaped retaining element for further retaining the first pivotal hinge piece and second pivotal hinge piece in a connected position; and wherein the first pivotal hinge piece and the second pivotal hinge piece are adapted to be disengaged by removal of said pin at the center pivot point, thereby allowing the first lateral slide component and the second lateral slide component to be positioned at an angle to one another.

11. The multifunctional exercise device of claim 10, further comprising a first slidable hand grip adapted to slide along the slide area of the first lateral slide component and a second slidable hand grip adapted to slide along the slide area of the second lateral slide component.

12. The multifunctional exercise device of claim 11, further including a resistance band connected to an outer end of the first lateral slide component and the first slidable hand grip for providing resistance for a user.

13. The multifunctional exercise device of claim 12, further including a second resistance band connected to an outer end of the second lateral slide component and the second slidable hand grip for providing resistance for a user.

14. The multifunctional exercise device of claim 10, wherein the first side pivot point, second side pivot point and center pivot point are adapted to pivot such that the first lateral slide component and the second lateral slide component are stacked.

15. The multifunctional exercise device of claim 10, further comprising a first adjustable foot connected to the inner end of the first lateral slide component and a second adjustable foot connected to the inner end of the second lateral slide component, said first adjustable foot and second adjustable foot allowing the first lateral slide component and the second lateral slide component to be independently adjusted to various equal or unequal heights based on positions of the first adjustable foot and the second adjustable foot, and the first side pivot point, second side pivot point and center pivot point.

16. A hinge assembly for use with a multifunctional exercise device comprising a first lateral slide component having an outer end, an inner end, and a slide area and a second lateral slide component having an outer end, an inner end, and a slide area, said hinge assembly comprising:

a first bracket piece fixed to the inner end of the first lateral slide component;

a second bracket piece fixed to the inner end of the second lateral slide component;

a first pivotal hinge piece with a first end and a second end;

a second pivotal hinge piece with a first end and a second end;

wherein said first pivotal hinge piece is pivotally connected to the first bracket piece at the first end creating a first side pivot point and pivotally connected to the second pivotal hinge piece at the second end creating a center pivot point, and said second pivotal hinge piece is pivotally connected to the second bracket piece at the first end creating a second side pivot point and pivotally connected to the first pivotal hinge piece at the second end at the center pivot point; and a removable pin for engaging the first pivotal hinge piece and second pivotal hinge piece in a connected and pivotable position at the center pivot point and a removable U-shaped retaining element for further retaining the first pivotal hinge piece and second pivotal hinge piece in a connected position, thereby securing the first lateral slide component and the second lateral slide component.

17. The hinge assembly of claim 16, wherein the first pivotal hinge piece and the second pivotal hinge piece are adapted to be disengaged by removal of said pin at the center pivot point, thereby allowing the first lateral slide component and the second lateral slide component to be positioned at an angle to one another.

* * * * *